US010198918B2

(12) United States Patent
Avdic

(10) Patent No.: US 10,198,918 B2
(45) Date of Patent: Feb. 5, 2019

(54) POINTING DEVICE FOR SHOWCASES

(71) Applicant: "Fredl's Glaserei" Amir Avdic e.U., Seeboden (AT)

(72) Inventor: Amir Avdic, Seeboden (AT)

(73) Assignee: "FRED L'S GLASEREI" AMIR AVDIC E.U., Seeboden (AT)

( * ) Notice: Subject to any disclaimer, the term of this patent is extended or adjusted under 35 U.S.C. 154(b) by 99 days.

(21) Appl. No.: 15/386,896

(22) Filed: Dec. 21, 2016

(65) Prior Publication Data

US 2017/0178467 A1 Jun. 22, 2017

(30) Foreign Application Priority Data

Dec. 22, 2015 (AT) ..... A 813/2015

(51) Int. Cl.

| | |
|---|---|
| ***F21V 21/096*** | (2006.01) |
| ***G08B 5/36*** | (2006.01) |
| ***F21V 21/14*** | (2006.01) |
| ***F21V 23/04*** | (2006.01) |
| *F21V 14/02* | (2006.01) |
| *F21W 121/00* | (2006.01) |
| *F21V 17/10* | (2006.01) |

(Continued)

(52) U.S. Cl.

CPC ..... *G08B 5/36* (2013.01); *F21V 21/096* (2013.01); *F21V 21/14* (2013.01); *F21V 23/04* (2013.01); *F21V 14/02* (2013.01); *F21V 17/105* (2013.01); *F21W 2121/00* (2013.01); *F21W 2131/405* (2013.01); *F21Y 2101/00* (2013.01); *F21Y 2115/30* (2016.08)

(58) Field of Classification Search

CPC ..... F21V 14/02; F21V 17/105; F21V 21/08; F21V 21/096; F21V 33/0008; F21W 2121/00; G08B 5/36

See application file for complete search history.

(56) References Cited

U.S. PATENT DOCUMENTS 4,538,214 A * 8/1985 Fisher ..... F21V 21/096 362/147

7,029,193 B1 4/2006 Chao (Continued)

FOREIGN PATENT DOCUMENTS

DE 1 9620 569 A1 11/1997

DE 20 2010 012 629 U1 12/2010

(Continued)

OTHER PUBLICATIONS

AT Search Report, dated May 25, 2016, from corresponding AT application.

(Continued)

*Primary Examiner* — Zheng Song

(74) *Attorney, Agent, or Firm* — Young & Thompson

(57) ABSTRACT

A pointing device (1) for generating light spots on a ware that is arranged in a showcase includes a part (3) that is arranged on the outside of the showcase panel (2), on which a light source (8) with an activating switch (11) is mounted. The device (1) also includes a part (4) that is arranged on the inside of the showcase panel (2) and has a hole (10) for the passage of the light beam (9), which is generated by the light source (8). The parts (3) and (4) of the device (1) are held together by magnetic forces and rest on the showcase panel (2) via sliding surfaces (6).

20 Claims, 1 Drawing Sheet

(51) Int. Cl.

| | |
|---|---|
| *F21Y 115/30* | (2016.01) |
| *F21W 131/405* | (2006.01) |
| *F21Y 101/00* | (2016.01) |

(56) References Cited

U.S. PATENT DOCUMENTS

| | | | | |
|---|---|---|---|---|
| 8,240,867 | B2 * | 8/2012 | Wang | A01K 63/06 362/101 |
| 8,523,380 | B1 | 9/2013 | Grant et al. | |
| 2007/0120392 | A1 * | 5/2007 | Wolfinger | F16B 45/00 296/100.17 |
| 2008/0273320 | A1 | 11/2008 | Ko | |
| 2011/0233228 | A1 | 9/2011 | Meacock et al. | |
| 2014/0211457 | A1 * | 7/2014 | Tarsa | F21S 8/06 362/147 |
| 2016/0348888 | A1 * | 12/2016 | Drews | A41D 27/085 |

FOREIGN PATENT DOCUMENTS

| | | | |
|---|---|---|---|
| DE | 20 2010 008 645 | U1 | 3/2011 |
| DE | 10 2013 104 365 | A1 | 10/2013 |
| EP | 1 258 438 | | 11/2002 |
| EP | 2 662 618 | A1 | 9/2011 |
| EP | 2 662 618 | A1 | 11/2013 |
| GB | 3 538 90 | A | 7/1931 |
| GB | 353890 | A | 7/1931 |

OTHER PUBLICATIONS

European Search Report issued in Application No. 16205436.5, dated Mar. 13, 2017.

* cited by examiner

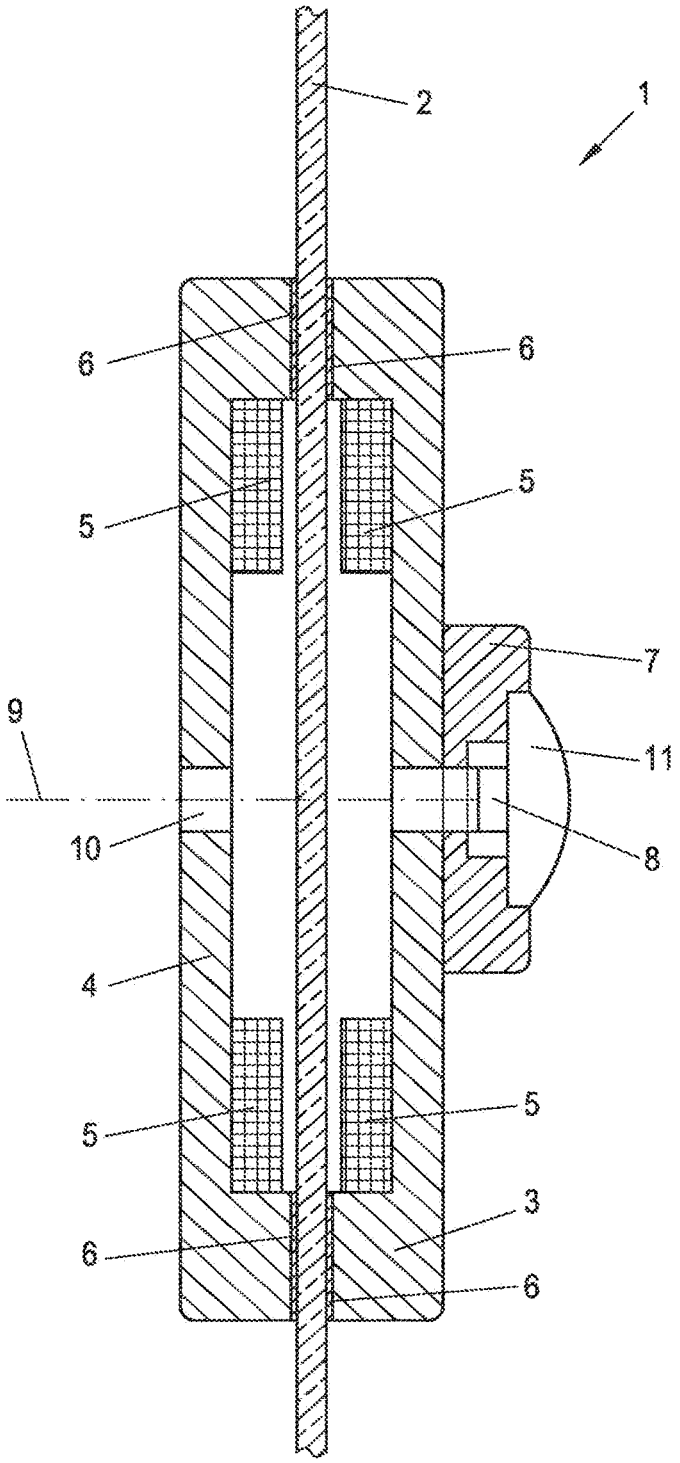
1
2
6
6
5
5
7
9
11
10
8
4
5
5
3
6
6

POINTING DEVICE FOR SHOWCASES

FIELD OF THE INVENTION

The invention relates to a pointing device for showcases with the features of the introductory part of claim 1.

BACKGROUND OF THE INVENTION

The problem of identifying wares provided in showcases often arises. Pointing to wares with one's finger is problematic, since the salesperson in general does not know exactly at which ware the customer is pointing.

It is known from GB 353,890 A that in the case of a vending machine, a light source is to be provided that illuminates the item selected by a dial similar to a telephone dial. As shown in FIG. 8 and explained on page 7, lines 87 to 100 and 106 to 124 of GB 353,890 A, the lamp-like light source is pivoted via a cam disk control, in such a way that it illuminates the selected item.

EP 2 662 618 A1 describes and shows a rod-shaped aquarium lamp, which has a fastening part. The fastening part consists of two segments, which are held together by magnetic forces. A glass panel is provided between the segments. The light emitted by the lamp does not pass through the segments of the fastening part.

US 2011/0233228 A1 relates to a vending machine, to which a pointing device that is similar to that of GB 353,890 A is assigned. A ball is provided as a control for the pointing device, so that the desired item can be highlighted. Only then is the purchase made.

SUMMARY OF THE INVENTION

The object of the invention is to indicate a device that in a simple way can point to the ware that is contained in a showcase and that the customer wants to purchase.

This object is achieved according to the invention with a device that has the features of Claim 1.

Advantageous and preferred configurations of the device according to the invention are subjects of the subclaims.

Since the device according to the invention, i.e. a "pointing device," is equipped with a source of a light beam and is mounted on the showcase panel in a movable way, the customer can create a light spot on the desired ware by moving the pointing device and activating the light source so that the salesperson can easily see what the customer would like to purchase.

The light source can be, for example, a laser beam, which is generated with a laser source similar to a laser pointer.

Holding the device on the panel, e.g., the glass plate, of a showcase is done in the case of the invention using magnetic forces, whereby one magnet is arranged on the outer side and the second magnet is arranged on the inner side of the showcase panel.

Additional details and features of the invention follow from the description below of a preferred embodiment based on the drawing, in which a device according to the invention is diagrammatically depicted in section.

BRIEF DESCRIPTION OF THE DRAWINGS

The sole FIGURE, FIG. 1, shows a pointing device for generating light spots on a ware that is arranged in a showcase.

DETAILED DESCRIPTION OF THE DRAWING EMBODIMENT

In the embodiment shown in the drawing FIG. 1, the device 1 according to the invention comprises a first holding part 3 that is arranged outside of the showcase panel 2 and a second holding part 4 that is arranged inside of the showcase panel 2. In the first holding part 3 that is arranged outside of the showcase panel 2, and in the second holding part 4 that is arranged inside of the showcase panel 2, magnets 5, for example annular magnets, with opposite polarities, are arranged in such a way that the magnets 5 mutually attract each other and thus are held on the showcase panel 2.

In order to avoid a scratching of the showcase panel 2 and to easily configure the movement of the device 1, sliding surfaces 6, for example in the form of felt cushions, are provided in the surfaces of the parts 3 and 4 that rest on the showcase panel 2.

On the first holding part 3 that is arranged on the outside of the showcase panel 2, a housing 7 is mounted, which houses a laser source 8, for example a laser pointer. The light source 8, for example the laser pointer, generates a light beam (laser beam) 9, which passes through the showcase panel 2 and through a hole 10 in the second holding part 4 and on the ware that is desired by the customer, (i.e., the ware that corresponds to the position of the device 1 according to the invention), and generates a light spot.

To activate the light source 8, i.e., to generate the light beam 9, a push switch 11 (button) is provided on the housing 7 of the outer part 4 of the device 1 according to the invention.

It can be seen that by moving the device 1 according to the invention along the showcase panel 2, optionally with an already activated laser pointer 8, a light spot can easily be generated on the ware that a customer wants to purchase.

In summary, an embodiment of the invention can be described, for example, as follows:

A pointing device 1 for generating light spots on a ware that is arranged in a showcase comprises a first holding part 3 that is arranged on the outside of the showcase panel 2, in which a light source 8 with a switch 11 is mounted. The device 1 also comprises a second holding part 4 that is arranged on the inside of the showcase panel 2 and has a hole 10 for the passage of the light beam 9, which is generated by the light source 8. The first and second holding parts 3,4 of the device 1 according to the invention are held together by magnetic forces and rest on the showcase panel 2 via sliding surfaces 6.

The invention claimed is:

1. A pointing device for generating a light spot on a ware that is arranged in a showcase behind a showcase panel, the device comprising:

a light source that generates a light beam that is to be focused on the ware, wherein the light source is arranged in a movable fashion on the showcase panel, wherein a first holding part rests on an outside of the showcase panel, wherein a second holding part rests on an inside of the showcase panel, wherein the first and second holding parts are held, by magnets exerting magnetic forces, so as to be attached to the outside and the inside of the showcase panel, wherein the light source is located in a housing arranged on the first holding part of the device that rests on the outside of the showcase panel, and wherein a hole, for the light beam to pass through and produce the light spot on the ware, is provided in the second holding part that rests on the inside of the showcase panel.

2. The device according to claim 1, wherein the light beam is a laser beam, which starts from the light source, the light source being a laser source that is arranged on the device.

3. The device according to claim 2, wherein the magnets are annular magnets for generating the magnetic forces, said magnets inserted into the first and second holding parts.

4. The device according to claim 2, wherein sliding surfaces are provided on surfaces of the first and second holding parts that rest on the showcase panel.

5. The device according to claim 2, wherein the housing has a push switch for activating the light source.

6. The device according to claim 2, wherein the first and second holding parts are flat and shell-shaped.

7. The device according to claim 1, wherein the magnets are annular magnets for generating the magnetic forces, said magnets inserted into the first and second holding parts.

8. The device according to claim 7, wherein sliding surfaces are provided on surfaces of the first and second holding parts that rest on the showcase panel.

9. The device according to claim 7, wherein the housing has a push switch for activating the light source.

10. The device according to claim 7, wherein the first and second holding parts are flat and shell-shaped.

11. The device according to claim 1, wherein sliding surfaces are provided on surfaces of the first and second holding parts that rest on the showcase panel.

12. The device according to claim 11, wherein the sliding surfaces are felt cushions.

13. The device according to claim 12, wherein the housing has a push switch for activating the light source.

14. The device according to claim 13, wherein the first and second holding parts are flat and shell-shaped.

15. The device according to claim 12, wherein the first and second holding parts are flat and shell-shaped.

16. The device according to claim 11, wherein the housing has a push switch for activating the light source.

17. The device according to claim 11, wherein the first and second holding parts are flat and shell-shaped.

18. The device according to claim 1, wherein the housing has a push switch for activating the light source.

19. The device according to claim 18, wherein the first and second holding parts are flat and shell-shaped.

20. The device according to claim 1, wherein the first and second holding parts are flat and shell-shaped.

* * * * *